US011800936B2

(12) United States Patent
Neff

(10) Patent No.: US 11,800,936 B2
(45) Date of Patent: Oct. 31, 2023

(54) APPARATUS FOR MOUNTING ATTACHMENTS TO A SEAT ASSEMBLY

(71) Applicant: Kevin Scott Neff, Eau Claire, WI (US)

(72) Inventor: Kevin Scott Neff, Eau Claire, WI (US)

( * ) Notice: Subject to any disclaimer, the term of this patent is extended or adjusted under 35 U.S.C. 154(b) by 0 days.

(21) Appl. No.: 17/852,746

(22) Filed: Jun. 29, 2022

(65) Prior Publication Data

US 2023/0026723 A1 Jan. 26, 2023

Related U.S. Application Data

(60) Provisional application No. 63/259,519, filed on Jul. 23, 2021, provisional application No. 63/259,520, filed on Jul. 23, 2021.

(51) Int. Cl.
*A47C 7/66* (2006.01)
*A47C 7/62* (2006.01)
*A47C 7/00* (2006.01)

(52) U.S. Cl.
CPC ..... *A47C 7/626* (2018.08); *A47C 7/004* (2013.01); *A47C 7/664* (2018.08)

(58) Field of Classification Search
CPC ..... A47C 3/18; A47C 7/626; A47C 7/664
USPC ..... 297/184.16, 144, 160, 161, 162, 184.11
See application file for complete search history.

(56) References Cited

U.S. PATENT DOCUMENTS 2,635,680 A * 4/1953 Zentmire ..... A47C 7/626 297/144 X
2,755,845 A * 7/1956 Robin ..... A47C 7/626 297/144
4,317,519 A * 3/1982 Talley ..... A47C 15/004 297/184.16 X
4,318,567 A * 3/1982 Guthier ..... A47C 9/10 297/184.16 X
4,341,418 A * 7/1982 Chappell ..... B60N 3/001 297/144 X
4,645,167 A * 2/1987 Hardwick ..... B63B 29/04 297/184.16 X
4,715,652 A * 12/1987 Ward ..... A47C 1/16 297/252
4,887,379 A * 12/1989 Harrison ..... B63B 29/04 297/188.12
5,524,957 A * 6/1996 Gibriano ..... A47C 7/70 297/144 X
5,586,806 A * 12/1996 Hergott ..... A47C 7/62 297/331
6,352,302 B1 * 3/2002 Piretti, Jr. ..... A47C 7/70 297/170

(Continued)

OTHER PUBLICATIONS

"Fisherman Sidekick", Allied Plastics Consumer Product Group. Retrieved Jun. 22, 2022, from https://fishermansidekick.com/.

*Primary Examiner* — Rodney B White
(74) *Attorney, Agent, or Firm* — FOLEY & LARDNER LLP

(57) ABSTRACT

An apparatus for mounting an attachment to a seat assembly including a seat mounted on a base includes a substantially planar, substantially rigid mounting plate configured to mount between the seat and the base, a first portion of the mounting plate engaging a plurality of threaded fasteners between the seat and the base, a second portion of the mounting plate extending beyond a perimeter of the seat, and an attachment attached to the second portion of the mounting plate such that the attachment does not interfere with a movement of the seat.

22 Claims, 6 Drawing Sheets

(56) References Cited

U.S. PATENT DOCUMENTS

| | | | | |
|---|---|---|---|---|
| 6,422,646 | B1 * | 7/2002 | McNally | A47C 7/70 297/161 |
| 7,540,561 | B2 * | 6/2009 | McWhorter | A47C 7/664 297/184.16 X |
| 8,002,349 | B1 * | 8/2011 | Pizzuto | A47C 1/143 297/188.05 |
| 8,696,056 | B2 * | 4/2014 | Corcorran | A47C 7/70 297/173 |
| 9,044,099 | B2 * | 6/2015 | Bouche | A47C 7/626 |
| 9,277,825 | B2 * | 3/2016 | Corcorran | F16M 11/22 |
| 9,693,625 | B2 * | 7/2017 | Lu | A47C 7/626 |
| 9,962,003 | B2 * | 5/2018 | Corcorran | A47C 7/62 |
| 9,986,837 | B2 * | 6/2018 | Czumaj-Bront | A47C 11/005 |
| 10,264,893 | B2 * | 4/2019 | Keilhauer | A47C 7/006 |
| 10,966,534 | B2 * | 4/2021 | Keilhauer | A47C 7/68 |
| 2005/0140187 | A1 * | 6/2005 | Kordecki | A47C 7/70 297/162 X |
| 2016/0198856 | A1 * | 7/2016 | Grace | A47C 4/22 297/16.1 |
| 2017/0066121 | A1 * | 3/2017 | Huang | A47C 7/62 |
| 2018/0110335 | A1 * | 4/2018 | O'Hagan | A47C 7/66 |
| 2019/0118908 | A1 * | 4/2019 | Hernandez | B63B 17/02 |

* cited by examiner

APPARATUS FOR MOUNTING ATTACHMENTS TO A SEAT ASSEMBLY

SUMMARY

In some aspects of the present description, an apparatus for mounting an attachment to a seat assembly including a seat mounted on a base is provided, the apparatus including a substantially planar, substantially rigid mounting plate configured to mount between the seat and the base and an attachment. The mounting plate includes a first portion which engages a plurality of threaded fasteners between the seat and the base, and a second portion of the mounting plate extends beyond a perimeter of the seat. The seat assembly is configured such that an attachment attached to the second portion of the mounting plate does not interfere with a movement of the seat.

In some aspects of the present description, an apparatus for mounting an attachment to a seat assembly including a swivel seat mounted on a base is provided, the apparatus including a substantially planar, substantially rigid mounting member and an attachment. The mounting member is configured to be mounted between the swivel seat and the base when the swivel seat and base are connected by a plurality of threaded fasteners. The mounting member includes a first portion disposed between a first subset of the plurality of threaded fasteners and a second subset of the plurality of threaded fasteners, and a second portion extending beyond a perimeter of the swivel seat. The seat assembly is configured such that an attachment attached to the second portion of the mounting member does not interfere with a movement of the swivel seat.

In some aspects of the present description, a seat assembly is provided, the seat assembly including a base section, a seat section disposed on the base section and attached to the base section via a plurality of threaded fasteners, an apparatus for mounting an attachment to the seat assembly, and the attachment attached to the apparatus. The apparatus includes a substantially planar, substantially rigid mounting member configured to mount between the seat section and the base section. A first portion of the mounting member engages at least a subset of the plurality of threaded fasteners between the seat section and the base section, and a second portion of the mounting member extends beyond a perimeter of the seat section. The attachment is attached to the second portion of the mounting member such that the attachment does not interfere with a movement of the seat section.

DETAILED DESCRIPTION

Figure 1A:
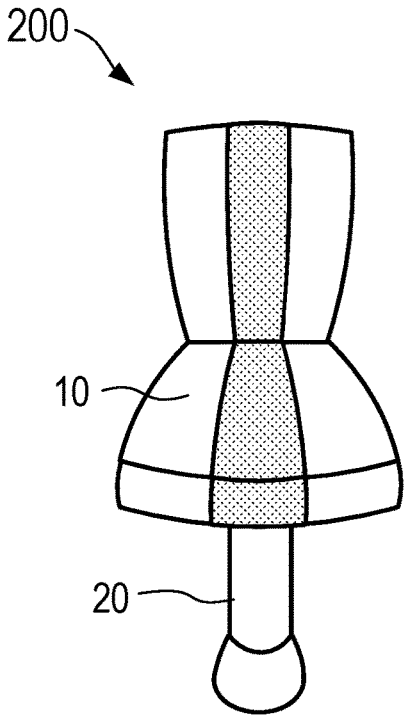
FIG. 1A Prior Art
FIGS. 1A and 1B show embodiments of a seat assembly, typical of the prior art.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

There are many applications for a rotating or swivel seat assembly, in which an upper seat section (the "seat") is attached to a lower base section (the "base", e.g., legs, a pedestal, lower console), typically with threaded fasteners such as bolts or screws. The seat section is typically attached to the base section in a way that allows the seat section to rotate or swivel from side to side. For example, swivel seats are often used in boats where a fisherman or other user can rotate the seat to face in different directions. Swivel seats are also commonly used for other applications, including bar stools, office chairs, piano seats, etc. It may be desirable to provide an attachment for a swivel seat assembly, such as an umbrella or a drink holder, and for that attachment to move along with the seat as it rotates.

For example, the Fisherman's Sidekick manufactured by the Allied Plastics Consumer Product Group in Twin Lakes, Wisconsin, is a caddy/organizer which mounts between the seat portion and the base portion. The Fisherman's Sidekick has a set of holes which line up with the 4-bolt pattern typical of many watercraft seats. One drawback of the Fisherman's Sidekick, however, is that the distance the caddy sticks out beyond the perimeter of the seat is fixed and cannot be adjusted, as there is only a single set of holes in the device. In addition, a device with a single, fixed set of holes will only work with that exact same bolt pattern (i.e., there is no adaptability for separate seat attachment methods, different bolt patterns, distances, etc.)

What is needed in the art is a method of mounting an attachment to a seat assembly between a seat portion and a base portion that is easily adjustable and which can work with multiple bolt/fastener patterns without being altered.

For the purposes of this description, the term "seat assembly" shall be defined to refer to an assembly including at least a seat (or "seat section") and a base (or "base section"). In some embodiments, per the present description, "seat assembly" may be used to refer to both seat assemblies of the prior art (e.g., water craft seats mounted on a pedestal, bar stool seats mounted on a base including legs, etc.) and to seat assemblies including the apparatus for mounting an attachment of the present description. The terms "seat" and "seat section" shall be considered synonymous and shall refer to the portion of the seat assembly upon which a user would sit. The terms "base" and "base section" shall also be considered synonymous and shall refer to the portion of the seat assembly upon which the seat or seat section is mounted (e.g., a pedestal base, a set of legs, etc.). The terms "mounting plate" and "mounting member" as used herein shall be synonymous and shall refer to the main body of the apparatus, the main body having a first portion configured to engage a set of threaded fasteners between seat and base and a second portion configured to extend out from a perimeter of the seat and to hold and support an attachment such that is the attachment is readily accessible by a person occupying the seat.

According to some aspects of the present description, an apparatus for mounting an attachment to a seat assembly including a seat mounted on a base may include a substantially planar, substantially rigid mounting plate configured to mount between the seat and the base. The mounting plate is configured such that an attachment attached to the mounting plate does not interfere with a movement of the seat. In some embodiments, the mounting plate may include a first portion which engages a plurality of threaded fasteners (e.g., bolts or screws) between the seat and the base, and a second portion of the mounting plate extends beyond a perimeter of the seat.

Various embodiments of the mounting plate, and various methods of the mounting plate engaging the plurality of threaded fasteners may exist. In some embodiments, the first portion of the mounting plate may further include a plurality of holes including at least a first subset of holes and a different second subset of holes. In some embodiments, there may be any number of subsets of holes, each subset spaced along a surface of the first portion of the mounting plate, each subset being a different distance from an outer end of the second portion of the mounting plate. In some embodiments, when the plurality of threaded fasteners is aligned with and contained within the first subset of holes, the second portion of the mounting plate may extend a first distance beyond the perimeter of the seat, and when the plurality of threaded fasteners is aligned with and contained in the second subset of holes, the second portion of the mounting plate may extend a second distance beyond the perimeter of the seat, wherein the first distance is different than the second distance. Stated another way, the distance that the second portion extends beyond the perimeter of the seat depends on which subset of holes is engaging the threaded fasteners.

In other embodiments, the first portion of the mounting plate may further include at least one slot, wherein the at least one slot is aligned to at least a subset of the plurality of threaded fasteners, such that the subset of the plurality of threaded fasteners is contained within the at least one slot. In some embodiments, the first portion of the mounting plate may have a first and a second elongated slot extending from the first portion of the mounting plate toward the second portion of the mounting plate (e.g., along a length of the mounting plate). In some such embodiments, the first elongated slot may engage (e.g., contain therethrough) a first subset of the threaded fasteners, and the second elongated slot may engage a different, second subset of threaded fasteners (e.g., in a typical four-bolt pattern, the first slot may contain two of the bolts, and the second slot may contain the remaining two bolts.) In some embodiments, the mounting plate may have only a single slot, and the single slot may engage or contain therethrough a subset of the threaded fasteners (e.g., two of the bolts in a four-bolt pattern). In some embodiments, a single slot may engage or contain therethrough a single threaded fastener. The length of the at least one slot in the mounting plate may be configured such that the mounting plate may be moved such that the subset of the plurality of threaded fasteners it contains there through is located within a different portion of the at least one slot (i.e., the length of the slot may be such that the mounting plate may be slid further in (such that the attachment is closer to the seat) or further out (such that the attachment extends further out from the perimeter of the seat).

In some embodiments, the first portion of the mounting plate may be configured to slide between at least a subset of the plurality of threaded fasteners between the seat and the base. For example, the first portion of the mounting plate may have no holes or slots but may instead be size such that the flat mounting plate can slide between the bolts in the bolt pattern. For example, if the bolt pattern is defined by four bolts located at the corners of an imaginary square, the mounting plate may be sized such that its width fits inside the bolt pattern with two bolts disposed on one side of the mounting plate and the other two bolts on the other side of the mounting plate.

For the purposes of this description, the mounting plate shall be considered to have dimensions of length (L), width (W), and thickness (T). These dimensions are defined in FIGS. 4A-4C based on the coordinate system shown with these figures. That is, the dimension of length, L, shall be defined as extending in the direction shown in FIG. 4A (i.e., the x direction shown beneath FIG. 4A), the dimension of thickness, T, shall be defined as extending in the direction shown in FIG. 4B (i.e., the z direction), and the dimension of width, W, shall be defined as extending in the direction shown in FIG. 4C (i.e., they dimension). The shape of the mounting plate is shown as a rectangle when seen in a top view in the figures herein. However, the mounting plate may have any appropriate shape when viewed from a top, plan view, and the examples in the figures are not meant to be limiting. For example, the widths of the first portion and the second portion may be different, as the first portion may be sized to engage the pattern of threaded fasteners while the second portion may be sized based on the type and size of attachment used (e.g., a wide, flat surface to support a tray, or a narrow surface to hold a cup holder).

Figure 4A:
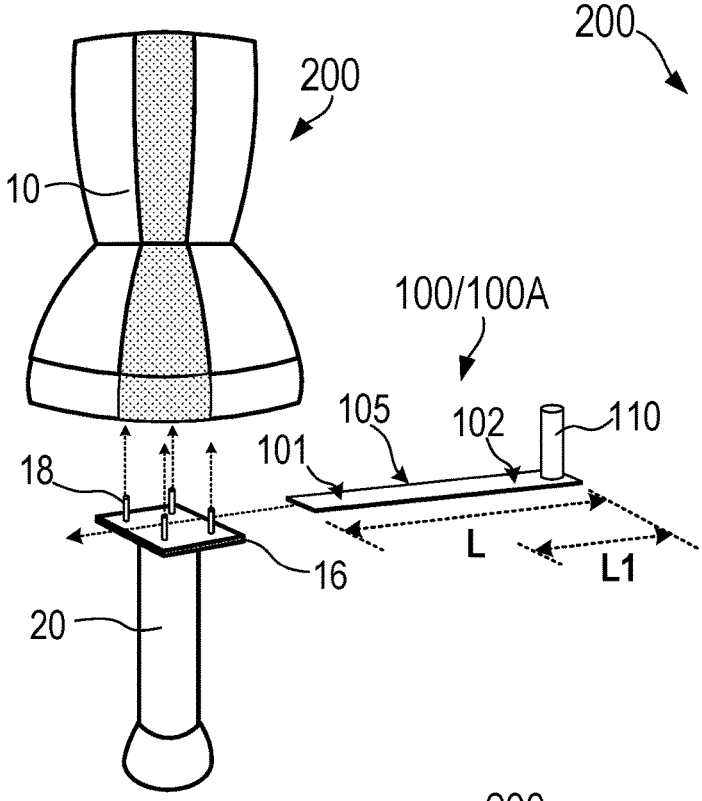
FIGS. 4A-4C provided perspective views of an apparatus for mounting attachments to a seat, in accordance with embodiments of the present description.
Figure 4B:
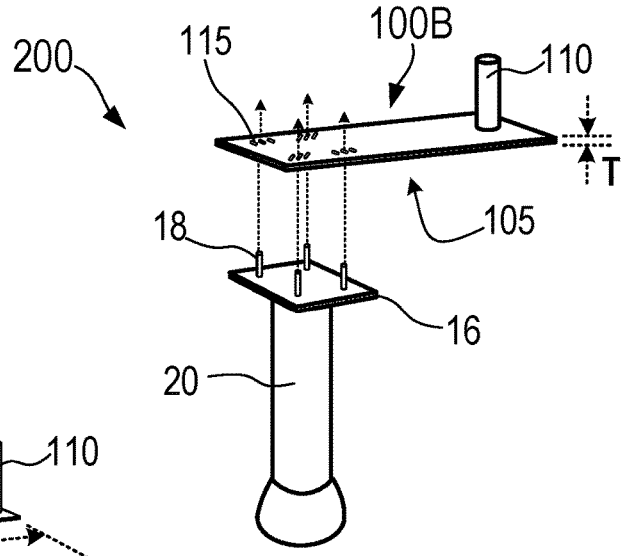
Figure 4C:
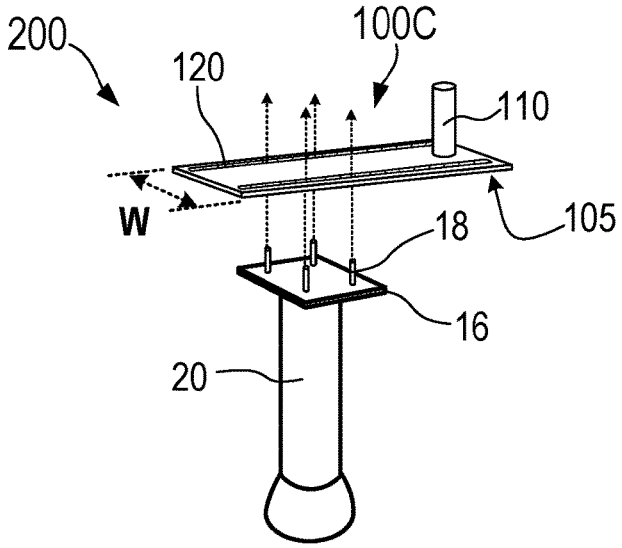
Figure 4C:
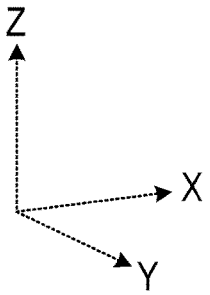

In such embodiments, the width, W, as further defined in FIG. 4C, will refer primarily to the width dimension of the first portion of the mounting plate, the portion which interacts with the pattern of threaded fasteners. As another example, the corners of the mounting plate may be angled or rounded to prevent damage to the seat material or injury to passersby. The overall shape of the mounting plate may be bent or at a slight angle, to better position the attachment relative to an occupant of the seat. The mounting plate may be constructed from any appropriate material, including, but not limited to, a metal, a metal alloy, a plastic, a plastic composite, a bio-composite, wood, fiberglass, or any combination thereof. The mounting plate may be constructed using any appropriate manufacturing method including, but not limited to, injection molding, die casting, 3D printing, sheet metal manipulation/cutting, mechanical forming/shaping, or any combination thereof.

The attachment mounted to the mounting plate may be any appropriate device, apparatus, container, or fixture. For example, in some embodiments, the attachment may be an umbrella holder, a cup holder, a storage container, a holder for a portable electronic device, a fishing rod holder, or any combination thereof. The attachment may be made of any material or combination of materials appropriate to the application. The means of attaching the attachment to the mounting plate may be any appropriate attachment method, including, but not limited to, molding integral with the mounting plate, adhered by adhesive/tape, welded, mechanical fasteners, mechanical latches or features, or any combination thereof.

In some embodiments, the apparatus for mounting an attachment to a seat mounted on a base may be part of a seat assembly, the seat assembly including a seat (e.g., a surface upon which a person can sit), a base (e.g., a pedestal, a set of legs, etc.), and any of the apparatuses for mounting an attachment to a seat assembly including a seat mounted on a base described herein. In such embodiments, the apparatus may be disposed between the seat and the base. In some such embodiments, the apparatus may engage the plurality of threaded fasteners used to connect the seat to the base. As described elsewhere herein, the phrase "engage the plurality of threaded fasteners" and like phrases may mean that the apparatus (the mounting plate or mounting member of the apparatus) slides between the threaded fasteners and/or captures some or all of the threaded fasteners in holes or slots in the mounting plate. In some embodiments, the seat assembly may be mounted in a vehicle, such as a boat, an automobile, or an aircraft. In other embodiments, the seat assembly may be configured as a bar stool, an office chair, or any other swiveling seat or chair.

In some embodiments of the seat assembly, the mounting plate may be attached between the seat and the base such that the rotation or swiveling of the seat does not cause a corresponding rotation of the mounting plate. For example, some embodiments of the seat assembly may utilize a swivel plate as the mechanism for rotation of the seat from side to side. In such embodiments, the swivel plate may include a top plate which is attached to (and swivels with) the seat and a bottom plate which is attached to (and remains stationary relative to) the base of the seat assembly. If the mounting plate of the apparatus is mounted below the swivel plate, the mounting plate will not rotate with the motion of the seat. If the mounting plate of the apparatus is mounted above the swivel plate, the mounting plate will rotate with the seat.

According to some aspects of the present description, an apparatus for mounting an attachment to a seat assembly including a swivel seat mounted on a base may include a substantially planar, substantially rigid mounting member. In some embodiments, the apparatus may further include an attachment. In some embodiments, the mounting member may be configured to be mounted between the swivel seat and the base when the swivel seat and base are connected by a plurality of threaded fasteners. In some embodiments, the mounting member may include a first portion disposed between a first subset of the plurality of threaded fasteners and a second subset of the plurality of threaded fasteners, and a second portion extending beyond a perimeter of the swivel seat. In some embodiments, the attachment may be attached to the second portion of the mounting member such that the device does not interfere with a movement of the swivel seat.

In some embodiments, the mounting member may be configured to be slid or inserted between the first subset of the plurality of threaded fasteners and the second subset of the plurality of threaded fasteners such that a length of the second portion which extends beyond the perimeter of the swivel seat may be changed. That is, before the threaded fasteners are tightened, the length of the mounting member which extends beyond the perimeter of the swivel seat can be sliding the mounting member further into the plurality of threaded fasteners to decrease the length of the mounting member which extends beyond the perimeter of the seat. Conversely, the mounting member may be slid further out from the plurality of threaded fasteners to increase the length of the mounting member which extends beyond the perimeter of the seat. Once the threaded fasteners (or a subset thereof) are tightened down, the mounting member may be prevented from sliding in either direction by the pressure between the seat and the base of the seat assembly.

In some embodiments, the mounting member of the apparatus may further include at least one slot extending along at least a portion of the length of the mounting member, such that at least one of the plurality of threaded fasteners extends therethrough (is captured and contained within) the slot. In some embodiments, the mounting member may have at least two slots, wherein each slot captures and contains a subset of the threaded fasteners. In some embodiments, the at least one slot may extend between a first closed end and a second closed end (i.e., sliding the mounting member in either direction is limited to when one of the threaded fasteners encounters either one of the closed ends; the mounting member may not be removed without removing the seat and exposing the ends of the threaded fasteners). In other embodiments, the at least one slot may extend between a first closed end and a second open end (i.e., sliding the mounting member in one direction, such that the threaded fasteners move toward the open end of the slot, will allow the mounting member to be pulled out from between the seat and the base without removing the seat, assuming the threaded fasteners are at least partially loosened.)

In some embodiments, the apparatus for mounting an attachment to a seat assembly including a swivel seat mounted on a base may be part of the seat assembly, the seat assembly including a swivel seat (e.g., a swiveling surface upon which a person can sit), a base (e.g., a pedestal, a set of legs, etc.) connected to the swivel seat via a plurality of threaded fasteners, and any of the apparatuses for mounting an attachment to a seat mounted on a base described herein. In some embodiments, the apparatus may be disposed between the swivel seat and the base between the first subset of the plurality of threaded fasteners and the second set of the plurality of threaded fasteners, such that a rotation or swiveling of the swivel seat does not cause a corresponding rotation of the mounting member of the apparatus. For example, as described elsewhere herein, when the seat assembly uses a swivel plate where the top plate rotates with the swivel seat and the bottom plate remains stationary with the base, the apparatus may be mounted between the bottom plate and the swivel plate such that it remains stationary when the seat section is swiveled. In other embodiments, the apparatus may be mounted between the top plate of the swivel plate and the swivel seat, such that the apparatus moves along with the seat when it is swiveling.

According to some aspects of the present description, a seat assembly includes a base section, a seat section disposed on the base section and attached to the base section via a plurality of threaded fasteners, an apparatus for mounting an attachment to the seat assembly, and an attachment (e.g., an umbrella holder, a fishing caddy, a drink holder, etc.) attached to the apparatus. In some embodiments, the apparatus may include a substantially planar, substantially rigid mounting member configured to mount between the seat section and the base section. In some embodiments, a first portion of the mounting member may engage at least a subset of the plurality of threaded fasteners between the seat section and the base section, and a second portion of the mounting member may extend beyond a perimeter of the seat section. In some embodiments, the attachment may be attached to the second portion of the mounting member such that the attachment does not interfere with a movement of the seat section.

Figure 1B:
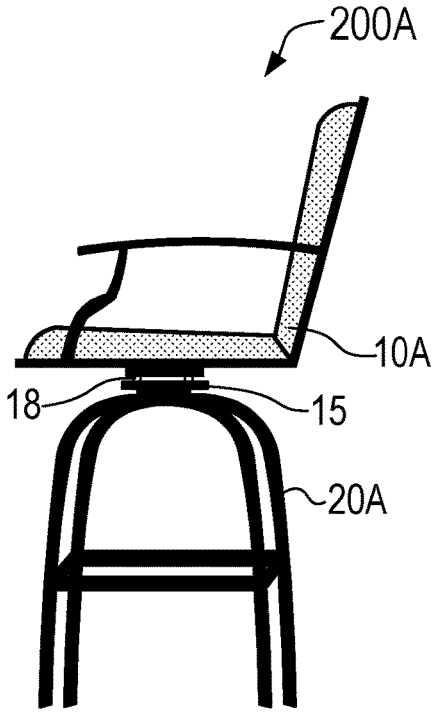
FIG. 1B Prior Art

Turning now to the figures, FIGS. 1A and 1B show embodiments of a seat assembly typical of the prior art. FIG. 1A shows a seat assembly (e.g., a swivel seat assembly) that may be found in a vehicle such as a watercraft. The seat assembly 200 may include a top seat or seat section 10 (i.e., the section of the seat assembly 200 upon which a user would sit) and a base section 20 (i.e., a pedestal or legs). In some embodiments, seat 10 may swivel or rotate relative to the base 20 (or relative to the surface upon which the seat assembly 200 rests).

Throughout this description, the numbers 200, 10, and 20 will be used to refer generally to a seat assembly, seat, and base, respectively. These same numbers may be used in combination with a letter designator to indicate variations or different embodiments of the same components. These variations or embodiments generally perform the same or a similar function to components having the base numbers (without the letter designator) unless specifically stated otherwise. For example, FIG. 1B shows a variation on a seat assembly 200A which is a swivel chair (e.g., a bar stool). Seat assembly 200A may include a seat 10A and a base 20A (e.g., a set of legs or a bottom structure supporting the seat 10A). In some embodiments, the seat 10A may be connected to the base 20A by a plurality of threaded fasteners 18 (e.g., bolts or screws). In some embodiments, the seat assembly 200A may further include a swivel mechanism 15 (e.g., a swivel plate) that allows the seat 10A to swivel relative to the base 20A. The seat 10A and base 20A in FIG. 1B are functionally similar to the seat 10 and base 20 in seat assembly 200 in FIG. 1A. In this description, the number 300 shall refer to a seat assembly including the apparatus of the present description (i.e., 300 refers to a seat assembly 200 which includes the apparatus 100). This will sometimes be referred to as a "final seat assembly" herein.

It should be noted that the figures presented herein are exemplary in nature and not intended to depict exact scale, shape, and look of their real-world counterparts. Various embodiments may exist which are similar in function to the examples depicted in the figures, but which may have minor differences compared to those presented in the figures. These embodiments should be considered to be within the scope of the present description.

Figure 2A:
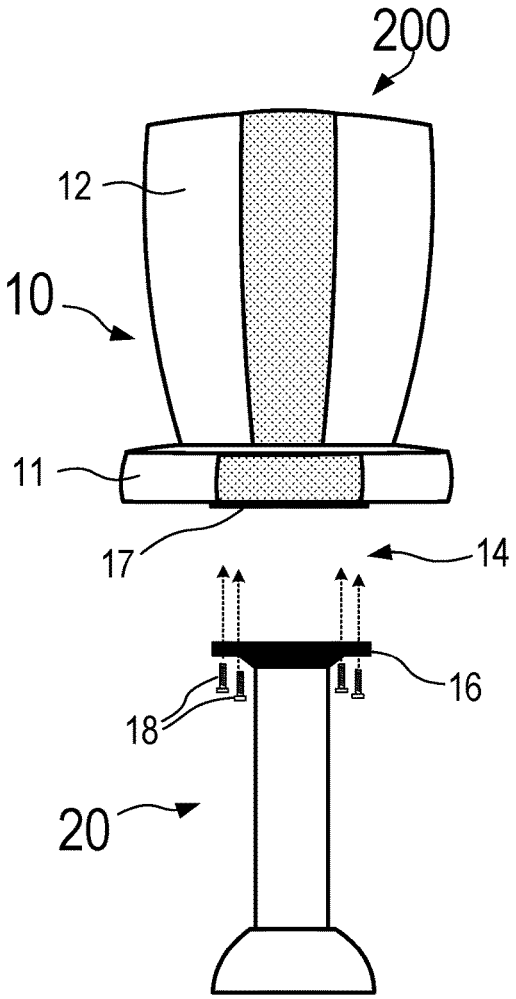
FIGS. 2A-2B provide front views of a seat assembly, in accordance with an embodiment of the present description.
Figure 2B:
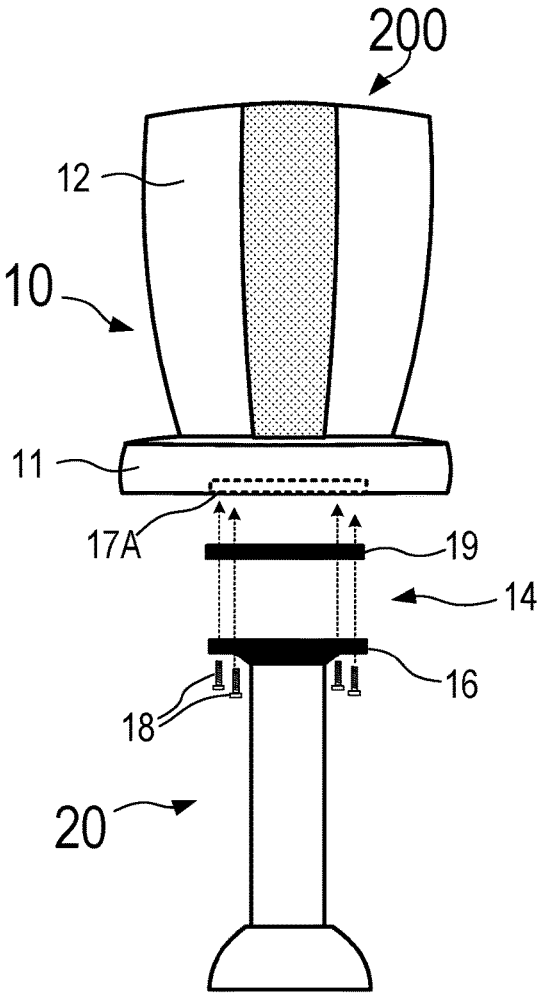

FIGS. 2A-2B provide front views of a seat assembly according to the present description. FIGS. 2A and 2B share many like-numbered components which shall be assumed to have the same function unless specifically stated otherwise. Starting with FIG. 2A, a seat assembly 200 may include a seat section (or "seat") 10 and a base section (or "base") 20. The seat 10 may itself include a seat platform 11 and a backrest 12. In some embodiments, seat 10 may include a plurality of holes (not shown in this angle but matching a pattern of bolts used to connect with the base 20) in a bottom surface 17. In the embodiment of FIG. 2A, the base 20 is connected to the bottom surface 17 by a plurality of threaded fasteners 18 (e.g., bolts or screws) which pass through a mounting plate 16 on the top of base 20 and into the holes in bottom surface 17.

In some embodiments, such as the embodiment shown in FIG. 2B, the bottom surface 17A may be slightly recessed up into the seat 10, so that the mounting plate 16 of base 20 fits into recessed bottom surface 17A when the seat 10 is attached to base 20. In such embodiments, it may be desirable to include a spacer 19 which fills recessed bottom surface 17A, such that mounting plate 16 is no longer recessed into the seat 10. In such embodiments, the spacer 19 may be desired to provide a smooth bottom surface to seat 10 for mounting of the apparatus described herein, such as apparatus 100 shown in at least FIG. 4A.

Figure 2C:
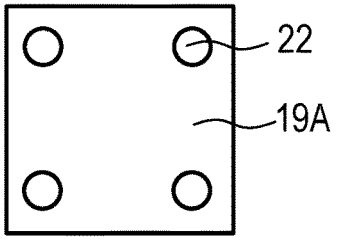
FIGS. 2C-2D provide top views of embodiments of a spacer for use in a seat assembly, in accordance with an embodiment of the present description.
Figure 2D:
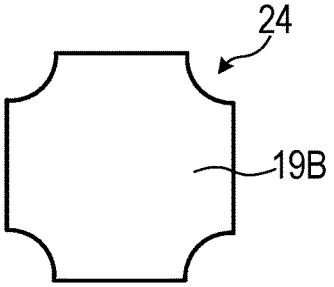

FIGS. 2C-2D provide top views of two possible embodiments of a spacer 19 for use in a seat assembly, such as seat assembly 200 of FIG. 2B. FIG. 2C shows embodiment of a spacer 19A which is shaped to fit into the recessed bottom surface 17A in seat 10 of FIG. 2B. In some embodiments, spacer 19A may include a set of through-holes 22 which pass through the thickness of the spacer to allow for the passage of the threaded fasteners 18 (see, e.g., FIG. 2B). In embodiment of the spacer 19B shown in FIG. 2D, the spacer 19B includes notched corners 24 instead of through-holes 22, which fulfill the same function as through-holes 22 of FIG. 2C (i.e., to allow threaded fasteners 18 to pass around spacer 19B). The embodiments of spacers shown in FIGS. 2C and 2D are examples only, and not intended to be limiting. Other designs of the spacers are possible within the scope of the present description.

Figure 3A:
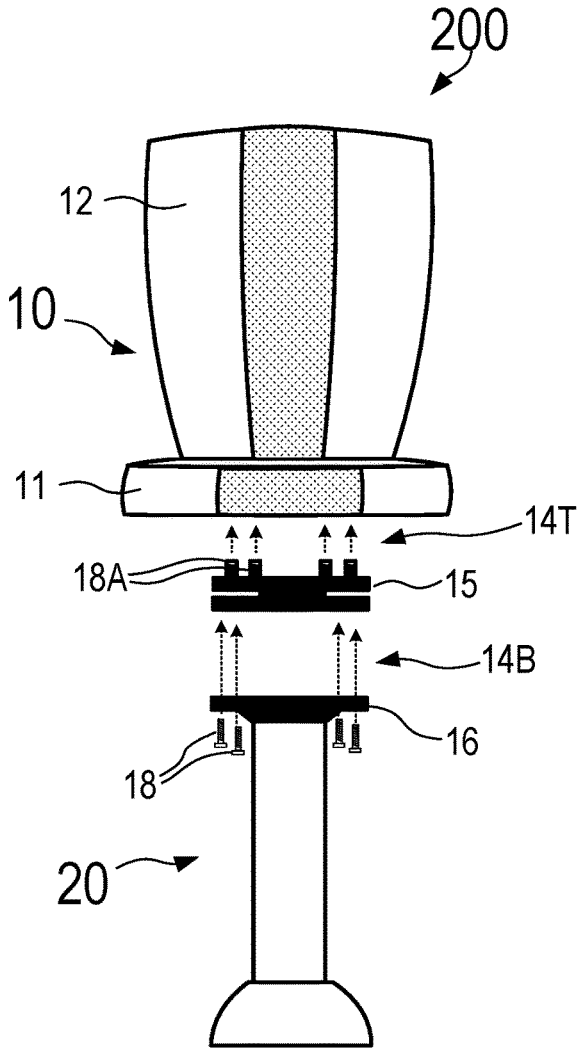
FIGS. 3A-3B provide views of a swiveling seat assembly, in accordance with an embodiment of the present description.
Figure 3B:
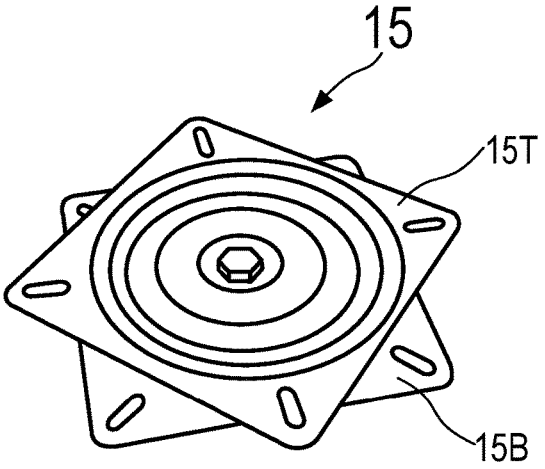

FIGS. 3A-3B provide views of an alternate embodiments of a swiveling seat assembly. The embodiment of seat assembly 200 of FIG. 3A shares many like-numbered components with FIGS. 2A and 2B and as thus shall be assumed to have the same function as previously described unless specifically stated otherwise. In the embodiment of seat assembly 200 of FIG. 3A, the base section 20 may not itself provide a swivel function. For example, when seat assembly 200 is in the form of a bar stool, the legs (i.e., base 20) of the bar stool may be stationary and may not include hardware to enable swiveling of the seat section 10. In such embodiments, the swivel function may be provided by a swivel mechanism such as swivel plate 15. Switching focus temporarily, FIG. 3B shows a more detailed view of swivel plate 15, which may include a top swivel plate surface 15T and a bottom swivel plate surface 15B. In some embodiments, top swivel plate surface 15T and bottom swivel plate surface 15B are configured such that they can rotate relative to each other around a center connection point. For example, top swivel plate surface 15T and bottom swivel plate surface 15B may be separated and connected by a bearing mechanism which allows then to rotate independently of each other.

Returning to FIG. 3A, in the embodiment shown, mounting plate 16 of base 20 may not be free to rotate relative to the base 20. In such embodiments, swivel plate 15 may be disposed between mounting plate 16 (or the top surface of base 20 if no separate mounting plate is used) and the seat section 10. In some embodiments, a first set of threaded fasteners 18 may be used to connect base 20 to swivel plate 15 (and specifically to bottom swivel plate surface 15B, FIG. 3B) and a second set of threaded fasteners 18A may be used to connect swivel plate 15 (and specifically top swivel plate surface 15T, FIG. 3B) to seat 10. In such embodiments, the presence of a swivel mechanism such as swivel plate 15 provides to points of connection in which the apparatus of the present description may be mounted, in between the seat 10 and swivel mechanism 15 (location 14T) or in between the swivel mechanism 15 and the base 20 (location 14B). When the apparatus (see FIGS. 4A-4C) is mounted in location 14T, the apparatus will rotate with the seat section 10. When the apparatus is mounted in location 14B, the apparatus will not rotate when the seat section 10 rotates.

FIGS. 4A-4C provided perspective views of various embodiments of an apparatus for mounting attachments to a seat assembly according to the present description. FIG. 4A shows the entire seat assembly 200 including seat section 10 and base section 20, while FIGS. 4B and 4C omit seat section 10 for simplicity. However, seat section 10 would be present in each of the embodiments of FIGS. 4B and 4C.

Turning first to FIG. 4A, an apparatus 100 for mounting an attachment 110 to a seat assembly is shown in an exploded view of seat assembly 200. When threaded fasteners 18 are loosened between seat 10 and base 20, seat 10 may be taken off base 20 (and mounting plate 16, if present). In some embodiments, apparatus 100 includes a substantially planar, substantially rigid mounting plate 105 (the long, substantially flat plate) configured to mount between the seat 10 and the base 20 and an attachment 110. When installed, a first portion 101 of mounting plate 105 engages a plurality of threaded fasteners 18 between the seat 10 and the base 20, and a second portion 102 of mounting plate 105 extends beyond a perimeter of seat 10 (hangs out and is visible when the seat 10 is securely fastened to base 20). In the embodiment of FIG. 4A, apparatus 100 (also referred to as apparatus embodiment 100A) is configured such that the width of the mounting plate 105 (see width, W, definition in FIG. 4C) is at least slightly less than the spacing between threaded fasteners 18. In this way, first portion 101 of mounting plate 105 can be slid in between at least a subset of the threaded fasteners 18. For example, when four threaded fasteners 18 are arranged at the corners of an imaginary square, as shown in FIG. 4A, first portion 101 may be inserted between (slid in between) the threaded fasteners 18 such that two of the threaded fasteners 18 are on a first side of first portion 101, and the other two threaded fasteners 18 are on an opposing, second side of first portion 101. When seat section 10 is then lowered into place and securing attached to base 20 via tightened threaded fasteners 18, first portion 101 of mounting plate 105 will be "trapped" or "sandwiched" between seat 10 and base 20, and second portion 102 may extend out beyond the perimeter of seat 10 by a distance L1 (a distance that is, by nature, a fraction of the total length, L, of mounting plate 105). It can be seen that the distance L1 may be adjusted to be longer or shorter based on the amount the first portion 101 is inserted between threaded fasteners 18 (i.e., by the amount the mounting plate 105 is shifted in either the positive x direction or the negative x direction, as shown in the coordinate system beneath FIG. 4A). Additional details on embodiment 100A of the apparatus are provided in FIG. 5A.

In the embodiment of FIG. 4B, mounting plate 105 of apparatus 100B includes a plurality of through-holes 115 (holes which pass all the way through the thickness, T, of mounting plate 105) through which the threaded fasteners 18 may pass to secure the mounting plate to seat assembly 200. In some embodiments, mounting plate 105 may have multiple sets of through-holes 115, each set spaced across the mounting plate in the x direction, to accommodate different L1 lengths (see FIG. 4A) when the seat 10 is installed. Additional details on embodiment 100B of the apparatus are provided in FIG. 5B.

In the embodiment of FIG. 4C, mounting plate 105 of apparatus 100C includes one or more slots 120 through which the threaded fasteners 18 may pass to secure the mounting plate to seat assembly 200. The slots 120 pass through the entire thickness, T, (see FIG. 4B) of mounting plate 105 and extend from one end of mounting plate 105 (from first portion 101, FIG. 4A) toward the opposite end of mounting plate 105 (toward or onto second portion 102). The length of the slots 120 allow the mounting plate 105 to be slid along the threaded fasteners 18 to achieve and appropriate L1 length for apparatus 100C. That is, the mounting plate 105 may be moved forward or rearward in the x direction as shown by the coordinate system to the left of FIG. 4C to achieve different functional lengths beyond the perimeter of seat 10. Additional details on embodiment 100C of the apparatus are provided in FIGS. 5C-5E.

It should be noted that, while the attachment 110 is shown in the figures as a simple cylinder (e.g., an umbrella holder or drink holder), this is meant to be an example only and is not intended to be limiting in any way. The attachment may be any appropriate device or platform that can be mounted to the end of the mounting plate, and may include, but not be limited to, an umbrella holder, a cup holder, a storage container, a holder or stand for a portable electronic device, a fishing rod holder, a tray, a work surface, or combinations thereof.

Figure 5A:
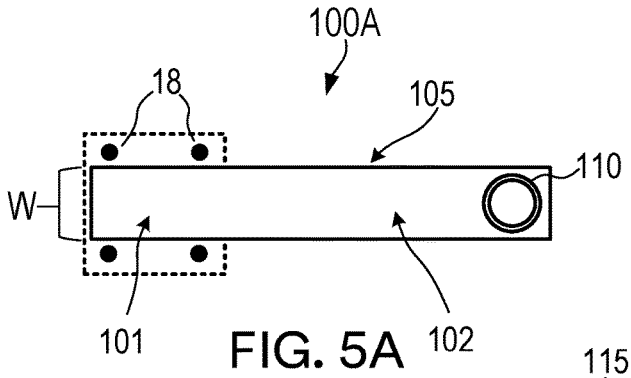
FIGS. 5A-5E show top, plan views of an apparatus for mounting attachments to a seat, in accordance with embodiments of the present description.

FIGS. 5A-5E show top, plan views of various embodiments of an apparatus 100 for mounting attachments 110 to a seat assembly. FIG. 5A shows a top view of embodiment 100A introduced in FIG. 4A. In embodiment 100A, a first portion 101 of mounting plate 105 may be configured such that the width, W, may pass between at least a subset of threaded fasteners 18. It should be noted that the width, W, of first portion 101 may be different than the width of second portion 102. For example, while width, W, of first portion 101 may be configured to fit between a subset of threaded fasteners (or between a first subset on a first side of mounting plate 105 and a second subset on an opposite, second side of mounting plate 105), the width of second portion 102 is not limited to this same restriction on width and may be wider or narrower as needed for the specific application.

Figure 5B:
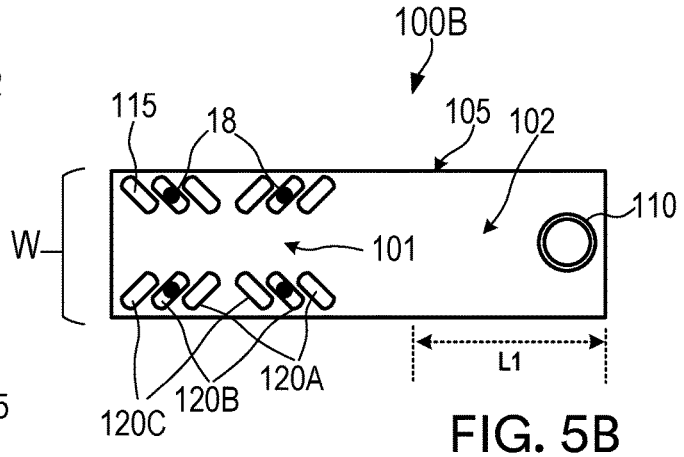

FIG. 5B shows a top view of embodiment 100B as introduced in FIG. 4B. In this embodiment, first portion 101 of mounting plate 105 may contain a plurality of through-holes 115 configured to engage at least a subset of threaded fasteners 18. The plurality of through-holes 115 may include two or more subsets of through-holes 115, where each subset is spaced further down mounting plate 105 toward second portion 102. For example, embodiment 100B of the apparatus shown in FIG. 5B has three subsets of through-holes, subsets 120A through 120C. The threaded fasteners 18 are shown as engaging the middle subset 120B in the example shown in FIG. 5B. The length L1 which the mounting plate 105 (and second portion 102) extends beyond the perimeter of seat 10 (as shown in FIG. 4B) may be adjusted by moving the threaded fasteners to subset 120A or 120C. Additional embodiments may include any appropriate number of through-hole subsets, such as 2 subsets, 3 subsets, 4 subsets, 6 subsets, 8 subsets, or 10 subsets.

Figure 5C:
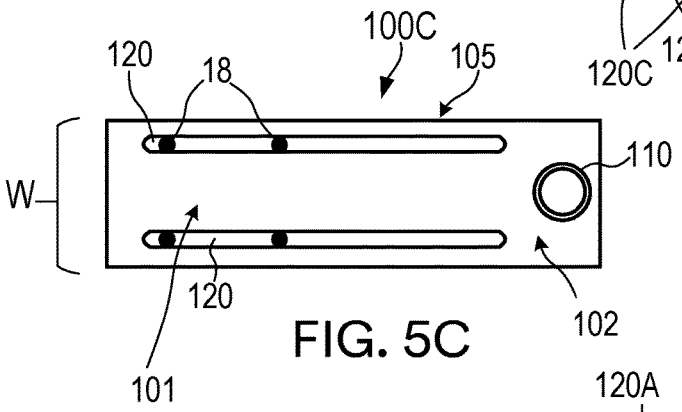
Figure 5D:
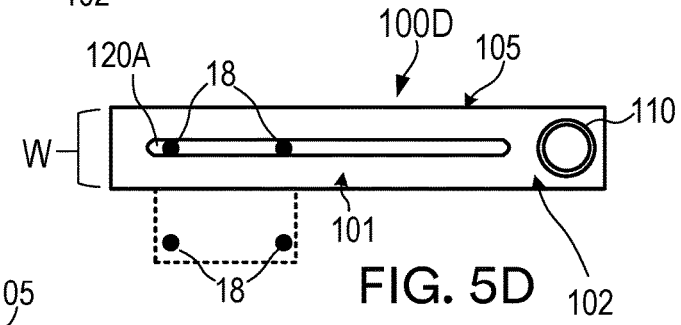
Figure 5E:
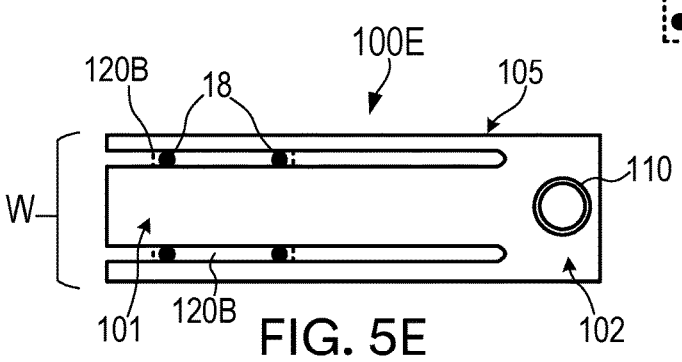

FIGS. 5C-5E shows top views of various embodiments of apparatus 100 in which the mounting plate 105 includes one or more slots 120. Slots 120 (or 120A, 120B, as shown in FIGS. 5D and 5E) extend from first portion 101 of mounting plate 105 toward or onto second portion 102 and are configured to be placed over threaded fasteners 18 (or a subset thereof) and to allow the mounting plate 105 to be moved over the threaded fasteners 18 in a direction substantially parallel to the slots 120. In embodiment 100C in FIG. 5C, mounting plate 105 contains two slots 120, with a first slot containing a first subset of threaded fasteners 18 and a second slot containing a second subset of threaded fasteners 18. In some embodiments, such as the embodiment 100D of FIG. 5D, the mounting plate 105 of apparatus 100D contains only a single slot 120A which is configured to capture and contain therein a subset of threaded fasteners 18. In the embodiment shown in FIG. 5D, slot 120A captures two of the threaded fasteners 18 of the total of four. In another embodiment, slot 120A may be configured to capture only a single threaded fastener 18.

The slots 120 and 120A of embodiments 100C and 100D are "closed" slots that extend from a first closed end (on first portion 101) to a second closed end (on or near second portion 102). Because they have closed ends, the seat section 10 of a seat assembly 200 must be removed (taken off the threaded fasteners 18 entirely) so that the slots can be inserted down over the threaded fasteners 18. In the embodiment 100E of FIG. 5E, the mounting plate 105 includes two slots 120B which extend from a first open end (on first portion 101, shown on the left side of FIG. 5E) to a second closed end (on or near second portion 102, shown on the right side of FIG. 5E). Because the first end of slot 120B is open, the slots 120B may be slid onto threaded fasteners 18 from the side (i.e., slid onto threaded fasteners 18 in a direction from the right side of FIG. 5E toward the left side) after simply loosening the threaded fasteners 18. In other words, the seat section 10 does not have to be taken completely off of threaded fasteners 18 in order to install apparatus 100E.

The embodiments of apparatus 100 shown in FIGS. 5A-5E are examples only and not intended to be limiting. Other embodiments than those shown may exist within the scope of the present description. For example, additional embodiments similar to those shown herein may be created for bolt patterns that do not match the square, 4-bolt pattern shown in the figures. Other embodiments may contain some combination of the through-holes, slots, and first portion widths described herein and be within the scope of the present description.

Figure 6A:
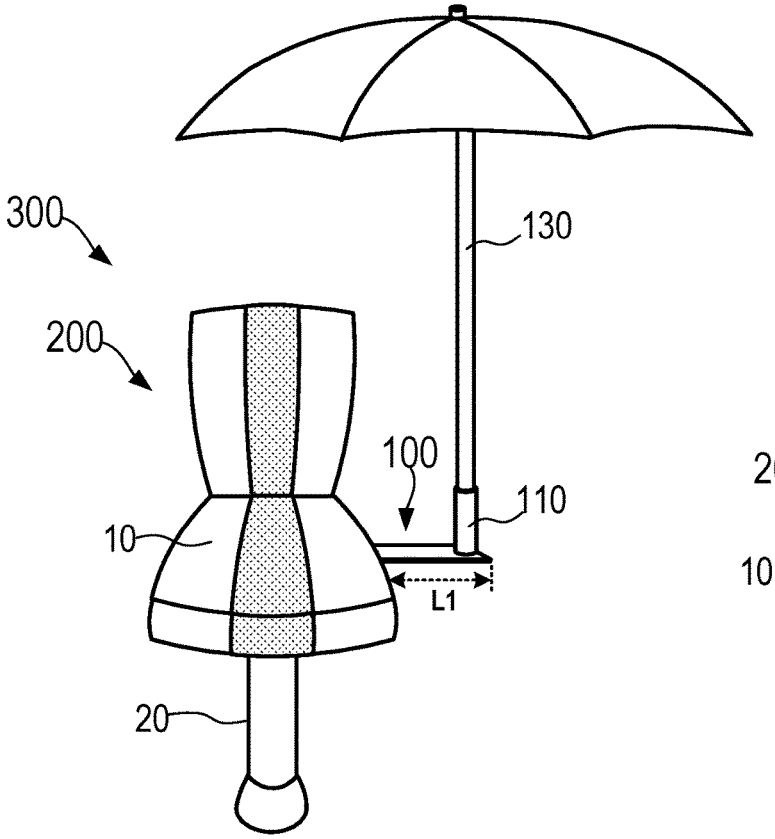
FIGS. 6A-6C provide perspective views of a final seat assembly including an apparatus for mounting attachments, in accordance with an embodiment of the present description.
Figure 6B:
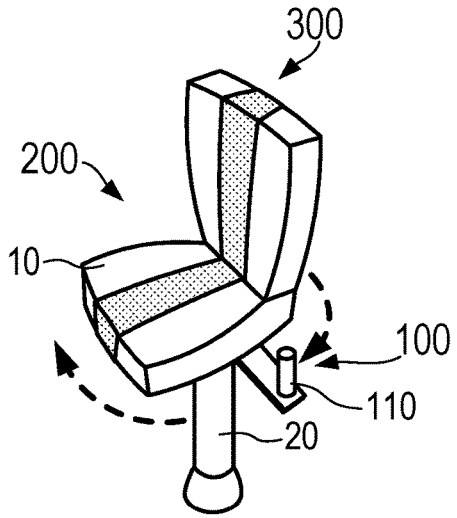
Figure 6C:
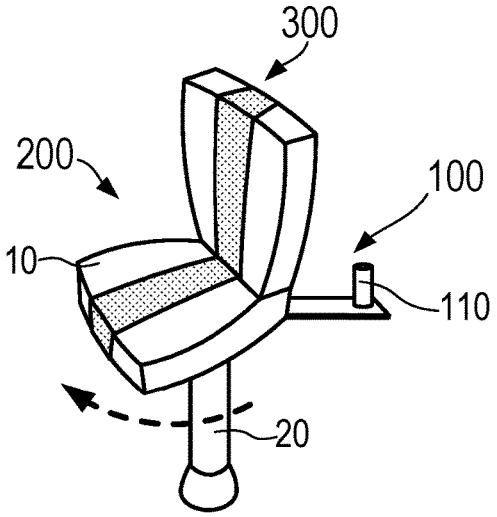

Finally, FIGS. 6A-6C provide perspective views of a final seat assembly 300 including the seat assembly 200 and the installed apparatus for mounting an attachment 100. FIG. 6A shows seat assembly 200 including seat section 10 and base section 20 with apparatus 100 in place, sandwiched between seat section 10 and base section 20. The apparatus 100 extends out beyond the perimeter of seat section 10 by a distance of L1. Distance L1 may be changed by moving the apparatus 100 further into (toward) seat section 10 or out (away) from seat section 10 as described elsewhere herein. In the example shown in FIG. 6A, attachment 110 is an umbrella holder holding an umbrella 130. However, as explained elsewhere herein, attachment 110 may be any appropriate attachment.

FIGS. 6B and 6C show alternate embodiments of final seat assembly 300 in which the apparatus 100 either rotates with the seat section 10 (FIG. 6B) or stays in place as seat section 10 rotates. These options are possible depending on the location in which the apparatus is mounted in the seat assembly 200 as explained elsewhere herein (e.g., see FIG. 3A and locations 14T and 14B, and the corresponding section of the description). It should be noted that, although the apparatus 100 is extending out from a side of the seat section 10, it may be mounted such that it extends in any appropriate direction, as required by a specific application. For example, it might be desirable to have the apparatus 100 extend out from the seat section 10 to the rear (i.e., behind a user occupying the seat 10) when the apparatus 100 is used to hold an umbrella. In other examples, the apparatus 100 may extend to the side, as shown in FIG. 6A (e.g., to hold a fishing tackle box) or even to the front of the seat (e.g., to hold a fishing rod in front of a user occupying seat 10). In yet other examples, it may be desirable to angle the apparatus 100 toward a corner of seat 10, somewhere between directly to the side and directly in front (e.g., to hold a video device far enough forward for viewing by a user occupying seat 10).

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof

What is claimed:

1. An apparatus for mounting an attachment to a seat assembly, the seat assembly comprising a seat mounted on a base, the apparatus comprising a substantially planar, substantially rigid mounting plate configured to mount between the seat and the base and comprising a first portion of the mounting plate configured to slide between at least a subset of the plurality of threaded fasteners between the seat and the base, and a second portion of the mounting plate extending beyond a perimeter of the seat;

wherein the attachment may be attached to the second portion of the mounting plate such that the attachment does not interfere with a movement of the seat.

2. The apparatus of claim 1, wherein the seat assembly is mounted in one of a boat, an automobile, and an aircraft.

3. The apparatus of claim 1, wherein the mounting plate comprises at least one open-ended slot configured to removably engage the at least a subset of the plurality of threaded fasteners without uncoupling the seat from the base.

4. The apparatus of claim 1, wherein the attachment is one or more of an umbrella holder, a cup holder, a storage container, a holder for a portable electronic device, a fishing rod holder, a tray, and a work surface.

5. A seat assembly comprising:

a seat;

a base connected to the seat via a plurality of threaded fasteners such that the seat can rotate relative to the base; and a substantially planar, substantially rigid mounting plate coupled between the seat and the base and comprising a first portion of the mounting plate engaging a plurality of threaded fasteners between the seat and the base, and a second portion of the mounting plate extending beyond a perimeter of the seat; and an attachment coupled to the second portion of the mounting plate such that a rotation of the seat causes a corresponding rotation of the mounting plate and the attachment does not interfere with a movement of the seat.

6. The seat assembly of claim 5, wherein the base comprises a swivel base and the attachment is one or more of an umbrella holder, a cup holder, a storage container, a holder for a portable electronic device, a fishing rod holder, a tray, and a work surface.

7. The seat assembly of claim 5, wherein the seat assembly is mounted in one of a boat, an automobile, and an aircraft.

8. The seat assembly of claim 5, wherein the mounting plate is releasably held between the seat and the base when the seat and the base are reversibly attached by the plurality of threaded fasteners.

9. An apparatus for mounting an attachment to a seat assembly comprising a swivel seat mounted on a base and connected to the base by a plurality of threaded fasteners, the apparatus comprising a substantially planar, substantially rigid mounting member configured to be mounted between the swivel seat and the base and comprising a first portion of the mounting member disposed between a first subset of the plurality of threaded fasteners and a second subset of the plurality of threaded fasteners, and a second portion of the mounting member extending beyond a perimeter of the swivel seat;

wherein the attachment may be attached to the second portion of the mounting member such that the attachment does not interfere with a movement of the swivel seat.

10. The apparatus of claim 9, where the mounting member is configured to be slid between the first subset of the plurality of threaded fasteners and the second subset of the plurality of threaded fasteners such that a length of the second portion which extends beyond the perimeter of the swivel seat may be changed.

11. The apparatus of claim 9, wherein the mounting member is configured to be slid between the first subset of the plurality of threaded fasteners and the second subset of the plurality of threaded fasteners when each of the plurality of threaded fasteners is at least partially loosened, and wherein the mounting member may be prevented from sliding when at least one of the plurality of threaded fasteners is tightened.

12. The apparatus of claim 9, wherein the mounting member further comprises at least one slot extending along at least a portion of the length of the mounting member, wherein at least one of the plurality of threaded fasteners extends through the slot.

13. The apparatus of claim 12, wherein the slot extends between a first closed end and a second closed end.

14. The apparatus of claim 12, wherein the slot extends between a first closed end and a second open end.

15. A seat assembly comprising:

a swivel seat;

a base connected to the swivel seat via a plurality of threaded fasteners such that the swivel seat can rotate relative to the base; and the apparatus of claim 9 disposed between the swivel seat and the base and between the first subset of the plurality of threaded fasteners and the second subset of the plurality of threaded fasteners, wherein a rotation of the swivel seat does not cause a corresponding rotation of the mounting member.

16. A seat assembly comprising:

a swivel seat;

a base connected to the swivel seat via a plurality of threaded fasteners such that the swivel seat can rotate relative to the base; and the apparatus of claim 9 disposed between the seat and the base and between the first subset of the plurality of threaded fasteners and the second subset of the plurality of threaded fasteners, wherein a rotation of the swivel seat causes a corresponding rotation of the mounting member.

17. A seat assembly comprising:

a base section;

a seat section disposed on the base section and attached to the base section via a plurality of threaded fasteners;

an apparatus for mounting an attachment to the seat assembly, the apparatus comprising a substantially planar, substantially rigid mounting member configured to mount between the seat section and the base section, a first portion of the mounting member engaging at least a subset of the plurality of threaded fasteners between the seat section and the base section, a second portion of the mounting member extending beyond a perimeter of the seat section; and an attachment attached to the second portion of the mounting member such that the attachment does not interfere with a movement of the seat section.

18. An apparatus for mounting an attachment to a seat assembly, the seat assembly comprising a seat mounted on a base, the apparatus comprising a substantially planar, substantially rigid mounting plate configured to mount between the seat and the base and comprising a first portion of the mounting plate engaging a plurality of threaded fasteners between the seat and the base, and a second portion of the mounting plate extending beyond a perimeter of the seat;

wherein the first portion of the mounting plate further comprises a plurality of holes comprising a first subset of holes and a different second subset of holes, such that when the plurality of threaded fasteners is aligned with and contained in the first subset of holes, the second portion of the mounting plate extends a first distance beyond the perimeter of the seat, and when the plurality of threaded fasteners is aligned with and contained in the second subset of holes, the second portion of the mounting plate extends a second distance beyond the perimeter of the seat, wherein the first distance is different than the second distance; and wherein the attachment may be attached to the second portion of the mounting plate such that the attachment does not interfere with a movement of the seat.

19. The apparatus of claim 18, wherein the attachment is one or more of an umbrella holder, a cup holder, a storage container, a holder for a portable electronic device, a fishing rod holder, a tray, and a work surface.

20. The apparatus of claim 18, wherein the seat assembly is mounted in one of a boat, an automobile, and an aircraft.

21. An apparatus for mounting an attachment to a seat assembly, the seat assembly comprising a seat mounted on a base, the apparatus comprising a substantially planar, substantially rigid mounting plate configured to mount between the seat and the base and comprising a first portion of the mounting plate engaging a plurality of threaded fasteners between the seat and the base, and a second portion of the mounting plate extending beyond a perimeter of the seat;

wherein the first portion of the mounting plate comprises at least one slot that is aligned with at least a subset of the plurality of threaded fasteners, such that the subset of the plurality of threaded fasteners is contained within the at least one slot; and wherein the attachment may be attached to the second portion of the mounting plate such that the attachment does not interfere with a movement of the seat.

22. The apparatus of claim 21, wherein the mounting plate may be moved such that the subset of the plurality of threaded fasteners is located within a different portion of the at least one slot.

* * * * *